US008684018B1

(12) United States Patent
Ni

(10) Patent No.: US 8,684,018 B1
(45) Date of Patent: Apr. 1, 2014

(54) AUTOMATIC UMBRELLA

(71) Applicant: Su-Chen Ni, Taipei (TW)

(72) Inventor: Su-Chen Ni, Taipei (TW)

( * ) Notice: Subject to any disclaimer, the term of this patent is extended or adjusted under 35 U.S.C. 154(b) by 0 days.

(21) Appl. No.: 13/668,335

(22) Filed: Nov. 5, 2012

(51) Int. Cl.
*A45B 25/16* (2006.01)
*A45B 25/00* (2006.01)
*A45B 25/14* (2006.01)

(52) U.S. Cl.
USPC ..... 135/20.3; 135/22; 135/23; 135/24

(58) Field of Classification Search
CPC ..... A45B 19/04; A45B 25/14; A45B 25/143; A45B 25/16
USPC ..... 135/20.3, 22, 23, 24
See application file for complete search history.

(56) References Cited

U.S. PATENT DOCUMENTS

| | | | | |
|---|---|---|---|---|
| 5,823,215 | A * | 10/1998 | Chou et al. | 135/24 |
| 8,365,747 | B1 * | 2/2013 | Su | 135/24 |
| 8,522,805 | B2 * | 9/2013 | Tan | 135/24 |
| 2002/0062850 | A1 * | 5/2002 | Kuo | 135/24 |
| 2003/0000558 | A1 * | 1/2003 | Chou | 135/15.1 |
| 2011/0214704 | A1 * | 9/2011 | Chang | 135/23 |

* cited by examiner

*Primary Examiner* — Noah Chandler Hawk
(74) *Attorney, Agent, or Firm* — Leong C. Lei

(57) ABSTRACT

An improved automatic umbrella including a tube plug fixed to a top of a second tube of a telescopic tube assembly, an inner tube fixed to the tube plug within the second tube of the telescopic tube assembly, a control tube being movably fitted in the inner tube, wherein the control tube is provided with a lower control pulley at its inner bottom end and the inner tube is provided with an upper control pulley at its inner top end, and a control line being provided such that a first end of the control line is fixed to a bullet head in the telescopic tube assembly, whereas a second end of the control line is sequentially looped around the upper control pulley and the lower control pulley, and finally fixed to a top end of the control tube, whereby the umbrella can be easily folded into a fully compact form.

3 Claims, 5 Drawing Sheets

AUTOMATIC UMBRELLA

(a) TECHNICAL FIELD OF THE INVENTION

The present invention relates to an improved automatic umbrella that includes a control tube in a telescopic tube assembly, whereby the umbrella can be easily folded into a fully compact form, and the risk occurred in the conventional automatic umbrellas can be reduced

(b) DESCRIPTION OF THE PRIOR ART

In an early automatic umbrella, as disclosed in U.S. Pat. No. 6,684,893 B2, a control device is provided in a handle thereof for controlling the operation of the umbrella. The control device includes a hollow main body, a control loop mounted in the hollow main body, and a button arranged at a side of the control ring, wherein the control loop is pivotally mounted with a control bar at a lower portion thereof and provided with a tongue at a side opposite to the button. The button is exposed through an opening of the handle, so that the umbrella can be operated through the button. However, for allowing the conventional umbrella to return to its originally compact form, the opening spring accommodated in the shaft of the umbrella should be compressed from a full extension of tubes (with a length of three tubes) to a full retraction of tubes (with a length of one tube), and this may bring inconvenience to a user. As a summary, the conventional umbrella has the following disadvantages:

1. Since the opening spring of the umbrella has a normal length of three tubes being extended, it is difficult for a user who has short hands to conduct a compression operation for obtaining a fully compact from of the umbrella.

2. The opening spring in the shaft of the umbrella should be compressed from a length of three tubes to a length of one tube. The compression range of the opening spring is large. Thus, it is difficult for a user who has less physical strength to conduct the compression operation.

3. If a user cannot operate the compression operation appropriately, the large restoring force of the opening spring may cause the shaft to spring out of the user's control and thus hit the hand or body of the user.

In view of the foregoing, the conventional umbrella indeed has drawbacks in structure and may bring some risk to a user. Thus, there is a need for improvement.

SUMMARY OF THE INVENTION

The primary object of the present invention is to provide an improved automatic umbrella that includes a control tube and a control line in a telescopic tube assembly, whereby the umbrella can be easily folded into a fully compact form.

The secondary object of the present invention is to provide an improved automatic umbrella, wherein an opening spring is arranged between a first tube and a second tube of the telescopic tube assembly, whereby the force required to compress the opening spring can be reduced, thereby alleviating the risk of operating the umbrella.

To achieve the above objects, the present invention includes a tube plug being fixedly attached to a top of the second tube of the telescopic tube assembly, an inner tube being fixedly mounted to the tube plug within the second tube of the telescopic tube assembly, a control tube being movably fitted in the inner tube, wherein the control tube defines a longitudinal through cut at its wall and is provided with a lower control pulley at its inner bottom end, the inner tube being provided with an upper control pulley at its inner top end, a control line being provided in the telescopic tube assembly such that a first end of the control line is fixed to a bullet head, whereas a second end of the control line is sequentially looped around the upper control pulley and the lower control pulley, and finally fixed to a top end of the control tube, and a runner pull line being connected between the tube plug, on the second tube of the telescopic tube assembly, and a runner of the umbrella.

In use, a user may press a button of the umbrella to allow the opening spring to move the second tube of the telescopic tube assembly upward, and allow the control line to move the third tube of the telescopic tube assembly upward, and allow the runner pull line to extend the ribs of the umbrella, to achieve the purpose of opening the umbrella. The user may press the button again to allow the bullet head to be disengaged from the first tube of the telescopic tube assembly. Therefore, the closing springs of the ribs may allow the runner and the third tube to move downward, so that the second tube can be totally retracted into the third tube of the telescopic tube assembly, and this can facilitate the user to manually fold the umbrella into a fully compact form.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
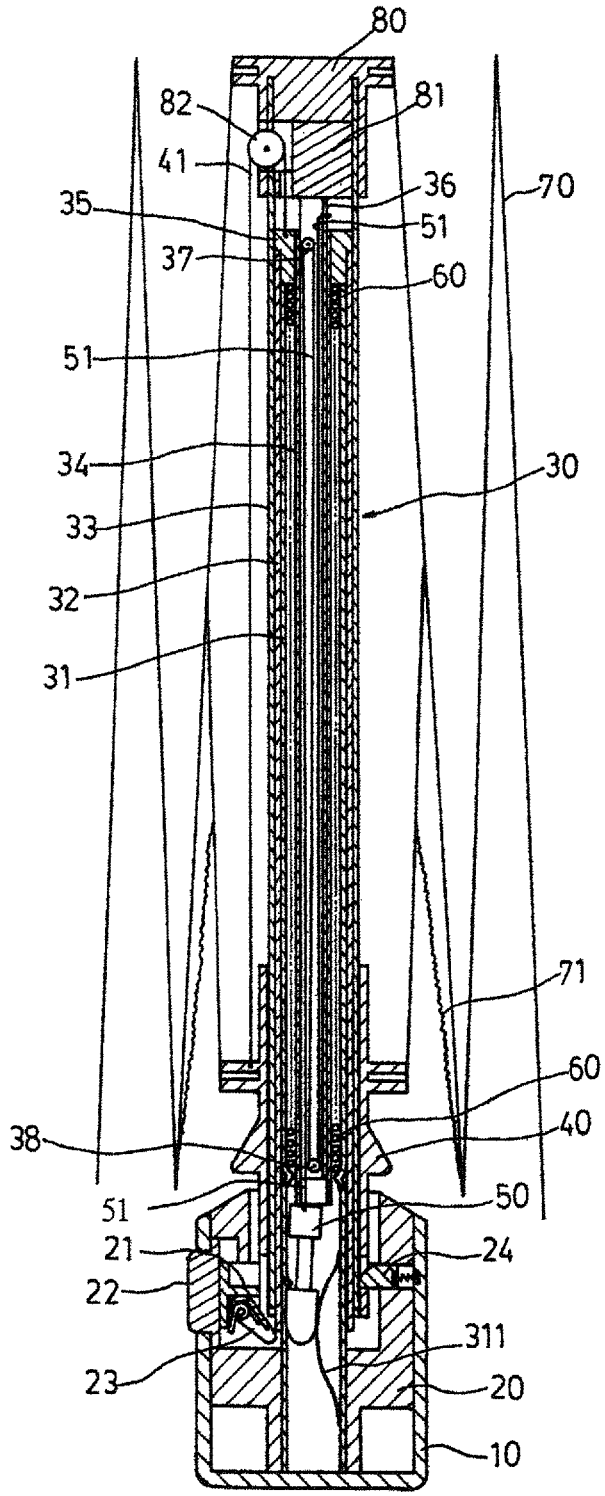
FIG. 1 shows a sectional view of one embodiment of the present invention, wherein the embodiment is in a fully folded state.

Referring to FIG. 1, an automatic umbrella according to one embodiment of the present invention is shown, which generally comprises a handle 10, a telescopic tube assembly 30, a cap 80, a runner 40, and a number of ribs 70. The handle 10 is provided with a control unit 20 therein. The control unit 20 contains a hollow main body mounted in the handle 10, a control ring 21, and a button 22. The control ring 21 is mounted in the hollow main body of the control unit 20. The button 22 is located at a side opening of the handle 10 and thus can be exposed for a user's control. The control ring 21 is further provided with a control lever 23 and an a protrusion 24, wherein the control lever 23 is pivotally mounted to a lower portion of the control ring 21, and the protrusion 24 is formed on the control ring 21 at a location opposite to the button 22, so that the protrusion 24 can engage with the runner 40, so that the umbrella can be held in a fully folded state. The telescopic tube assembly 30 contains a first tube 31, a second tube 32, and a third tube 33. In this embodiment, the first tube 31 is the innermost tube, the second tube 32 is the middle tube, and the third tube 33 is the outmost tube. A bottom of the first tube 31 is fixedly attached to the main hollow body of the control unit 20 in the handle 10. The cap 80 is fixedly attached to a top of the third tube 33 of the telescopic tube assembly 30. A tube plug 35 is fixedly attached to a top of the second tube 32 of the telescopic tube assembly 30. An inner tube 34 is fixedly mounted to the tube plug 35 within the second tube 32. The runner 40 is fitted over the telescopic tube assembly 30. An opening spring 60 is arranged between the first tube 31 and the second tube 32 of the telescopic tube assembly 30. The ribs 70, each containing a closing spring 71, are mounted between the cap 80 and the runner 40. A cap plug 81 is fixedly attached to a bottom of the cap 80 and provided with a pulley 82 at a side thereof, corresponding to an opening of the third tube 33, so that a runner pull line 41 can be routed by way of the pulley 82 and connected between the second tube 32 and the runner 40, wherein one end of the runner pull line 41 can be fixed to the tube plug 35 on the second tube 32, whereas the other end of the runner pull line 41 can be looped around the pulley 82 and fixed to the runner 40. The telescopic tube assembly 30 is provided with a bullet head 50 therein, as will be fully described later.

Figure 4:
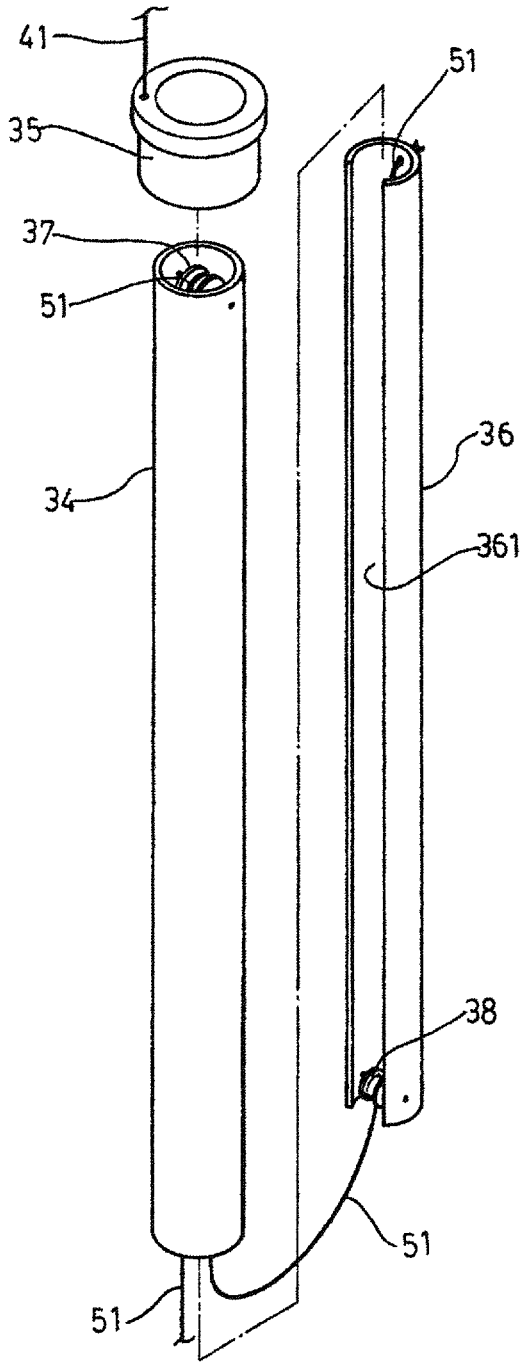
FIG. 4 shows a 3-dimensional exploded view of an inner tube and a control tube of the embodiment of the present invention.

Referring to FIGS. 1 and 4, as mentioned above, the tube plug 35 is fixedly attached to the top of the second tube 32; the inner tube 34 is fixedly mounted to the tube plug 35; one end of the runner pull line 41 is fixed to the tube plug 35 on the second tube 32, whereas the other end of the runner pull line 41 is looped around the pulley 82 provided at the cap plug 81 of the cap 80 and fixed to the runner 40. Furthermore, the present embodiment provides a control tube 36, which can be movably fitted in the inner tube 34, wherein the control tube 36 defines a longitudinal through cut 361 at its wall and provided with a lower control pulley 38 at its inner bottom end. The inner tube 34 is provided with an upper control pulley 37 at its inner top end. A control line 51 is provided in the telescopic tube assembly 30 such that a first end of the control line 51 is fixed to the bullet head 50, whereas a second end of the control line 51 is sequentially looped around the upper control pulley 37 and the lower control pulley 38, and finally fixed to a top end of the control tube 36. The longitudinal through cut 361 of the control tube 36 is defined for being clear of the upper control pulley 37 so that the control tube 36 can be freely moved relative to the inner tube 34.

Referring back to FIG. 1, the umbrella shown in the figure is in a fully folded state, wherein the opening spring 60 within the telescopic tube assembly 30 is compressed by the tube plug 35 on the top of the second tube 32; the runner 40 is engaged with the protrusion 24 of the control ring 21 and thus held in position; the control lever 23 is tilted by the telescopic tube assembly 30; the bullet head 50 is urged by the inner tube 34, pushed sideways by a spring piece 311 fixed to the first tube 31, and blocked by a fin formed on the first tube 31.

Figure 2:
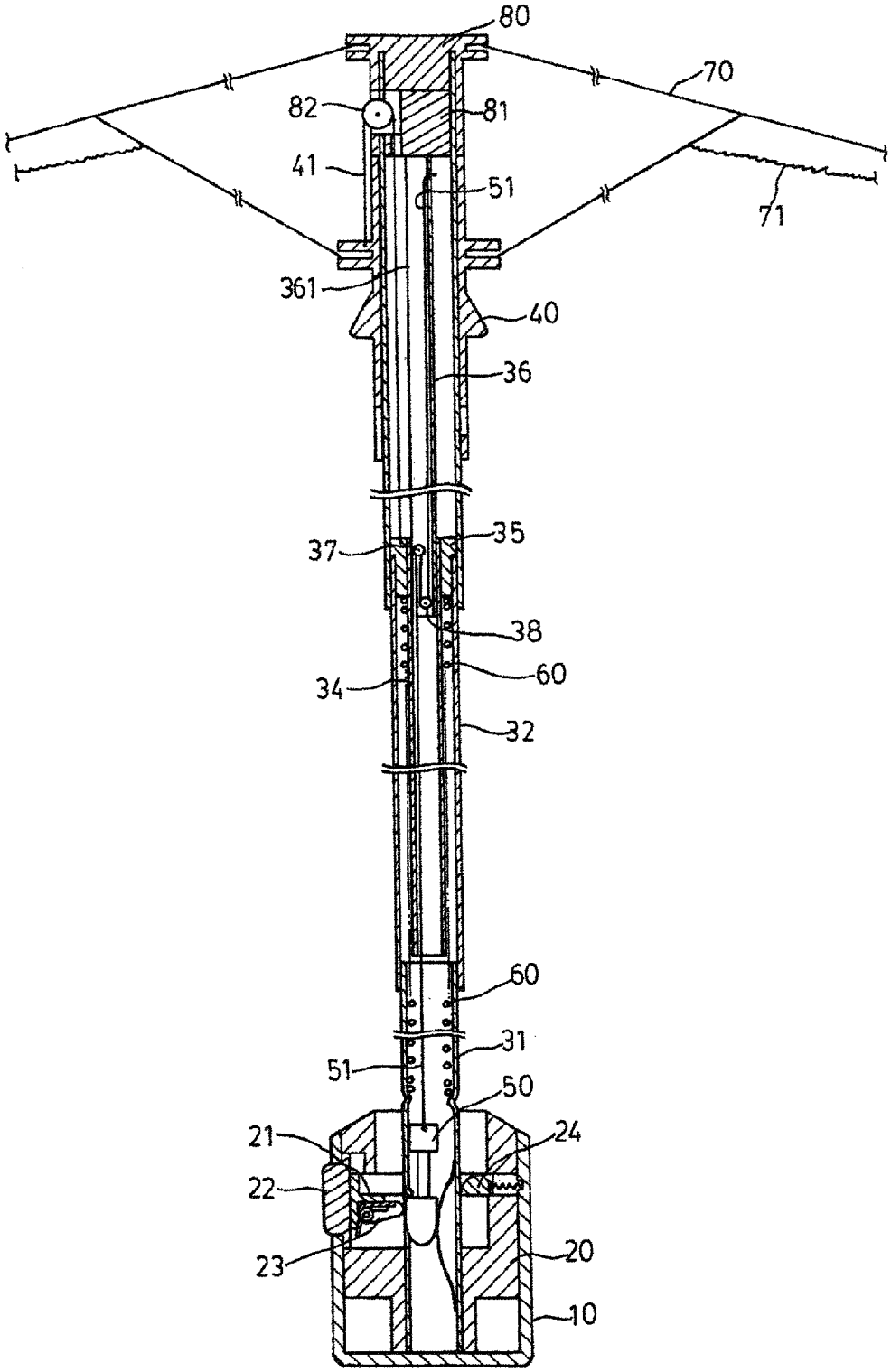
FIG. 2 shows a sectional view of the embodiment of the present invention, wherein the embodiment is in a fully extended state.

When a user want to open the umbrella, he or she may press the button 22 to move the control ring 21 inward, so that the protrusion 24 of the control ring 21 can be disengaged from the runner 40. Consequently, due to the compressed opening spring 60 having a tendency to restore to its originally normal state, the second tube 32 can be pushed upward (see FIG. 2). At this time, the bullet head 50 is still blocked by the fin formed on the first tube 31. With the control line 51 in cooperation with the upper control pulley 37 and the lower pulley 38, the control tube 36 abutting the cap plug 81 of the cap 80 can be moved relative to the second tube 32, thereby pushing the third tube 33 upward. As a result, the runner 40 can be moved upward by the runner pull line 41, so that the ribs 71 can be extended to open the umbrella. After the umbrella is opened, the closing springs 71 of the ribs 70 can become stretched, and the control lever 23 can return to its horizontal state and point to the bullet head 50.

Figure 3:
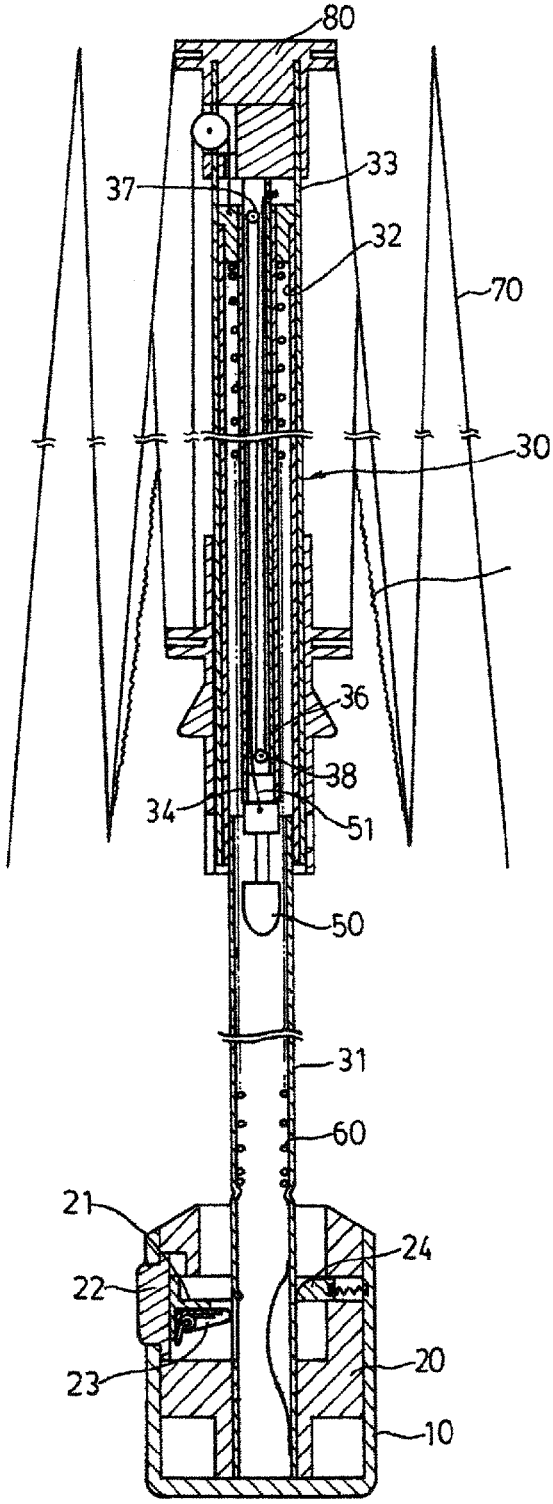
FIG. 3 shows a sectional view of the embodiment of the present invention, wherein the embodiment is in a semi-folded state.

When the user want to close the umbrella, he or she may press the button 22 again to push the bullet head 50 sideways to allow the bullet head 50 to be clear of the fin formed on the first tube 31, so that, under the restoring force of the closing springs 71, the ribs 70 can be folded again, so that the runner 40 and the third tube 33 can be moved downward (see FIG. 3). As a result, the second tube 32 can totally retract into the third tube 33. In other words, the third tube 33 can totally receive the second tube 32. Under this condition, the telescopic tube assembly 30 would appear as a 2-fold tube assembly (i.e., the umbrella is in a semi-folded state), thereby facilitating the user to manually fold the umbrella into a fully compact form.

Figure 5:
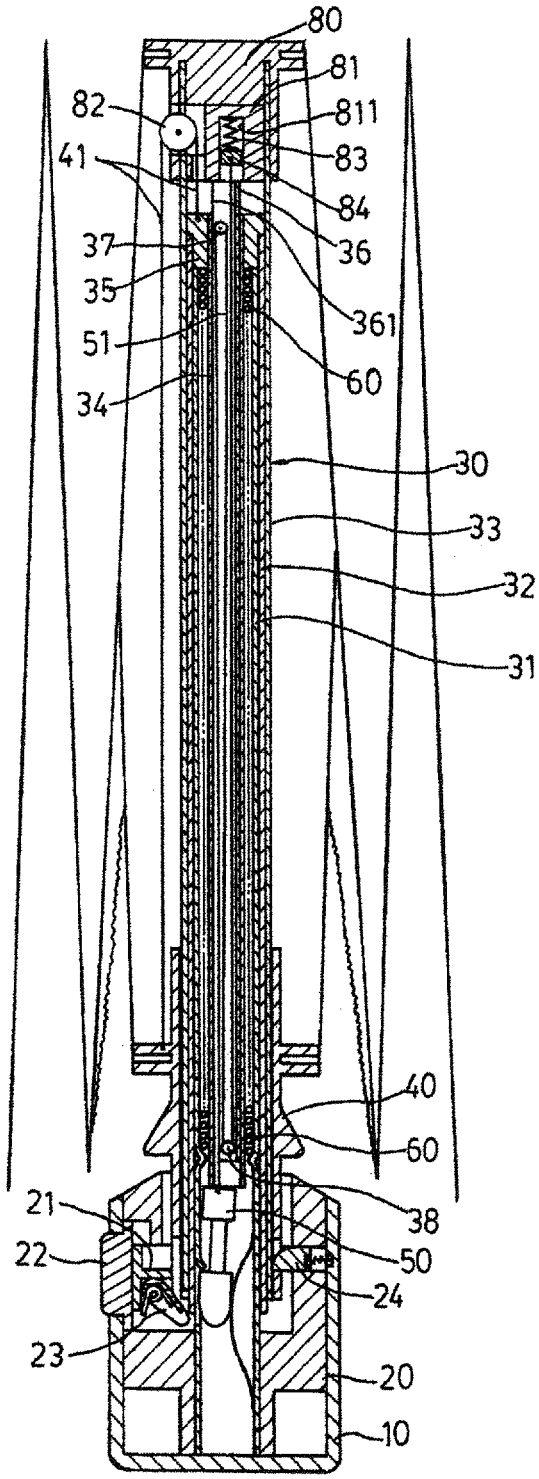
FIG. 5 shows a sectional view of another embodiment of the present invention.

FIG. 5 shows another embodiment of the present invention, wherein the cap plug 81 defines a recess 811 at a bottom thereof. Within the recess 811, a small spring 83 and a movable block 84 are disposed. One end of the small spring 83 is fixed to a bottom of the recess 811, whereas the other end of the small spring 83 is fixed to the movable block 84. As in the previous embodiment, a tube plug 35 is fixedly attached to the top of the second tube 32; an inner tube 34 is fixedly mounted to the tube plug 35 within the second tube 32 of the telescopic tube assembly 30; a runner pull line 41 is routed by way of the pulley 82 and connected between the second tube 32 and the runner 40, wherein one end of the runner pull line 41 is fixed to the tube plug 35 on the second tube 32, whereas the other end of the runner pull line 41 is looped around the pulley 82 of the cap 80 and fixed to the runner 40. Also, this embodiment provides a control tube 36, which can be movably fitted in the inner tube 34, wherein the control tube 36 defines a longitudinal through cut 361 at its wall and provided with a lower control pulley 38 at its inner bottom end. The inner tube 34 is provided with an upper control pulley 37 at its inner top end. A control line 51 is provided in the telescopic tube assembly 30 such that a first end of the control line 51 is fixed to the bullet head 50, whereas a second end of the control line 51 is sequentially looped around the upper control pulley 37 and the lower control pulley 38, and finally fixed to the movable block 84. The longitudinal through cut 361 of the control tube 36 is defined for being clear of the upper control pulley 37 so that the control tube 36 can be moved relative to the inner tube 34. With the damping capability of the movable block 84, breakages or damages of the control line 51, the upper control pulley 37, or the lower control pulley 38 can be mitigated.

Although the above embodiments employ a 3-fold tube assembly for illustration, the present invention may include additional tubes. For example, the present invention can employ a 4-fold or 5-fold tube assembly, wherein the fourth tube and the fifth tube can be located below the second tube.

Although the present invention has been described with a certain degree of particularity, it is understood that the present disclosure is made by way of example only and the combination and arrangement of parts may be resorted to without departing from the spirit and scope of the invention hereinafter claimed.

I claim:

1. An improved automatic umbrella of the type that includes a handle, a telescopic tube assembly, a cap, a runner, and a number of ribs, the handle being provided with a control unit containing a button and a control ring having a control lever and a protrusion, the telescopic tube assembly containing a first tube, a second tube, and a third tube, the cap being fixedly attached to a top of the third tube of the telescopic tube assembly and being provided with a pulley, the runner being fitted over the telescopic tube assembly, a tube plug being fixedly attached to a top of the second tube of the telescopic tube assembly, the telescopic tube assembly being provided with a bullet head and an opening spring therein, the ribs each containing a closing spring and being mounted between the cap and the runner, a runner pull line being connected such that one end of the runner pull line is fixed to the tube plug on the second tube of the telescopic tube assembly, whereas the other end of the runner pull line is looped around the pulley of the cap and fixed to the runnel; wherein the improvement comprises:

the opening spring being arranged between the first tube and the second tube of the telescopic tube assembly, an inner tube being fixedly mounted to the tube plug within the second tube of the telescopic tube assembly, a control tube being movably fitted in the inner tube, the control tube defining a longitudinal through cut at its wall and provided with a lower control pulley at its inner bottom end, the inner tube being provided with an upper control pulley at its inner top end, a control line being provided in the telescopic tube assembly such that a first end of the control line is fixed to the bullet head, whereas a second end of the control line is sequentially looped around the upper control pulley and the lower control pulley, and finally fixed to a top end of the control tube.

2. The improved automatic umbrella of claim 1, wherein the cap defines a recess, within which a small spring and a movable block is disposed, one end of the small spring being fixed to a bottom of the recess whereas the other end of the small spring being fixed to the movable block, the second end of the control line being fixed to the movable block instead of being fixed to the top end of the control tube.

3. The improved automatic umbrella of claim 1, wherein the tube telescopic assembly includes additional tubes to form a 4-fold or 5-fold tube assembly.

* * * * *